United States Patent [19]

Long et al.

[11] Patent Number: 4,491,279

[45] Date of Patent: Jan. 1, 1985

[54] PORTABLE ROCK CRUSHING AND CONVEYING SYSTEM

[75] Inventors: Wallace H. Long; Ralph Ruggiero, both of Tucson, Ariz.

[73] Assignee: Duval Corporation, Houston, Tex.

[21] Appl. No.: 379,512

[22] Filed: May 18, 1982

[51] Int. Cl.[3] ..... B02C 2/00

[52] U.S. Cl. ..... 241/101.7; 241/152 A; 241/285 R

[58] Field of Search ..... 241/101.7, 285 R, 285 A, 241/285 B, 207-216, 152 A

[56] References Cited

U.S. PATENT DOCUMENTS

| | | | |
|---|---|---|---|
| 378,516 | 2/1888 | Oliver . | |
| 525,419 | 9/1894 | Hoyt . | |
| 1,096,307 | 5/1914 | Kirksey . | |
| 1,693,343 | 11/1928 | Morgan . | |
| 1,950,501 | 3/1934 | MacKay . | |
| 2,144,384 | 1/1939 | Mikan . | |
| 2,609,152 | 9/1952 | Brough . | |
| 2,711,858 | 6/1955 | Kennedy . | |
| 3,385,014 | 5/1968 | Haug . | |
| 3,490,632 | 1/1970 | McKinney . | |
| 3,545,690 | 12/1970 | Burian et al. . | |
| 3,598,224 | 8/1971 | Oury et al. . | |
| 3,599,378 | 8/1971 | Kachnic . | |
| 4,383,651 | 5/1983 | Couperus | 241/101.7 X |

FOREIGN PATENT DOCUMENTS

| | | | |
|---|---|---|---|
| 1657115 | 4/1972 | Fed. Rep. of Germany . | |
| 2320487 | 11/1974 | Fed. Rep. of Germany . | |
| 2640367 | 3/1978 | Fed. Rep. of Germany . | |
| 2640366 | 3/1978 | Fed. Rep. of Germany . | |
| 401404 | 2/1974 | U.S.S.R. | 241/101.7 |
| 719690 | 3/1980 | U.S.S.R. | 241/101.7 |

OTHER PUBLICATIONS

Mining Equipment International, Nov.-Dec. 1981, pp. 28-29.

Weserhutte-Mobilbrecher-Reference List.

Krupp-Mobile Crushing Installations-Reference List.

*Primary Examiner*—Mark Rosenbaum

*Attorney, Agent, or Firm*—Stevens, Davis, Miller & Mosher

[57] ABSTRACT

A rock crushing and conveying apparatus for an open pit mining operation having an apron feeder conveyor, a rock crushing assembly and an endless belt drive station, each of which are capable of being lifted by a transporter vehicle and moved within the strip mine to different locations to reduce the amount of time lost in transporting raw material from the actual mining site to the rock crusher. The gyratory crusher is housed in a toroidal body mounted on three legs and elevated so that the underside of the body, which has a load bearing ring under the crusher, is accessible to said transporter vehicle.

9 Claims, 12 Drawing Figures

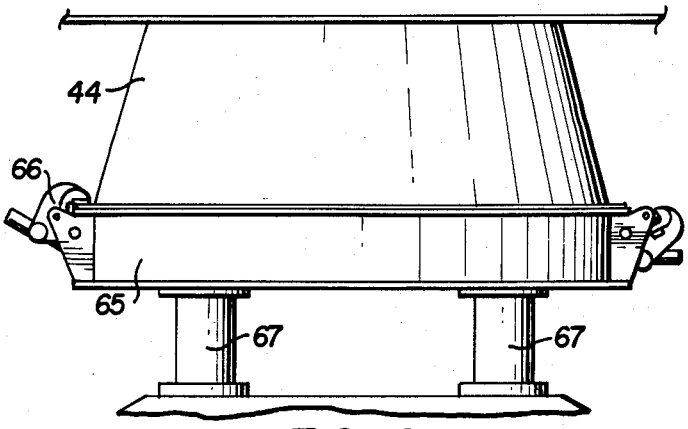
FIG. 8a
FIG. 8b
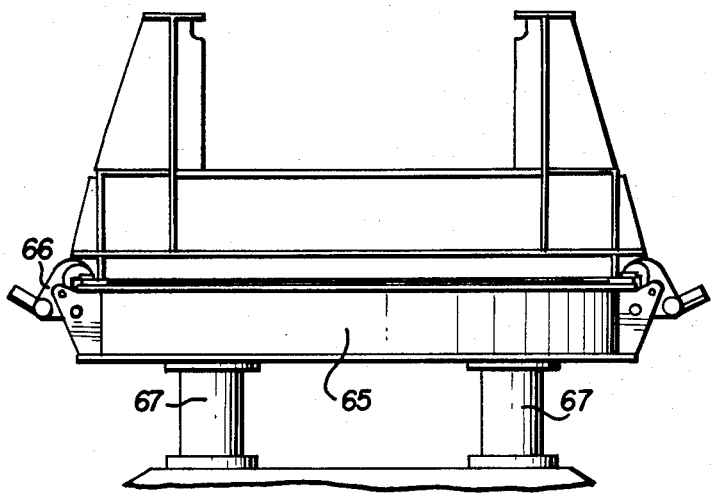
FIG. 8c
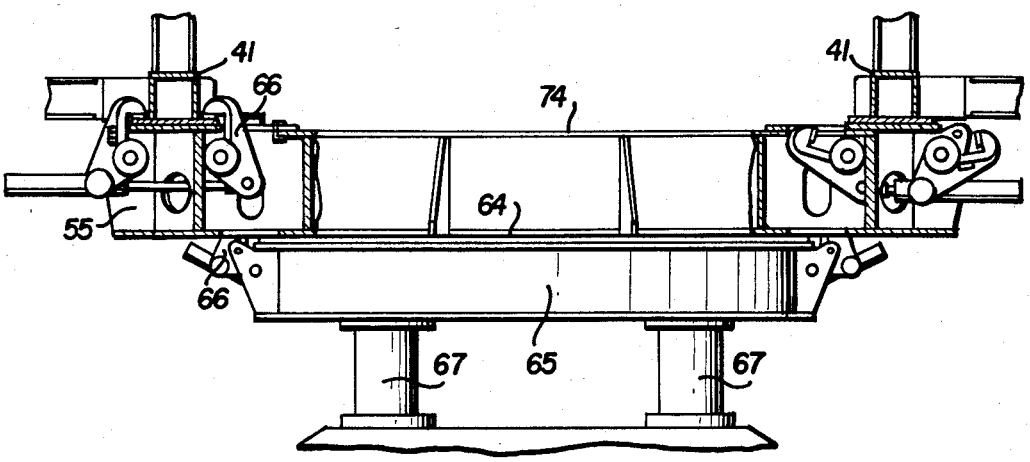

PORTABLE ROCK CRUSHING AND CONVEYING SYSTEM

BACKGROUND OF THE INVENTION

1. Field of the Invention

The present invention relates to equipment for crushing and conveying raw material from an open pit mining operation. More particularly, the invention is concerned with providing material crushing and conveying equipment which may be relatively easily moved so as to be in the vicinity of current mining operations within a large open pit.

2. Description of the Prior Art

Previously, rock crushing units for open pit mining operations have been more or less permanently situated at one location in the mining site. As the site of actual mining operations moved and the pit became larger, it was necessary that the raw material i.e. the uncrushed ore be transported over increasing distances usually by truck. This resulted in ever-increasing operating hours for the trucks with corresponding increases in costs, fuel usage and mechanical failure.

It has been known to mount rock crushers on a frame which is self-propelled, for example by caterpillar-type treads or a walking mechanism. However, these crushing units have been on a relatively small scale, of quite complicated construction and have not been capable of carrying the large gyratory type crushers necessary in modern high tonnage open pit or strip mining operations.

SUMMARY OF THE INVENTION

It is an object of this invention to provide an apparatus for crushing and conveying ore bearing rock from an open pit or strip mining operation so as to decrease the amount of time necessary for transporting from the actual mining site to the crushing apparatus.

It is a further object of this invention to provide a portable rock crushing system capable of handling the high volume and weight of ore produced in a modern large scale open pit or strip mining operation.

It is a still further object of this invention to provide a portable rock crushing system for a mining operation which may be moved between mining locations within the pit or strip mining site by means of a separate transporter vehicle which is adapted to move the crusher unit and, in a separate operation with the same transporter, to move at least one of the conveyors associated with the crusher.

The above and other objects are obtained by providing a rock crusher which is supported on an elevated structure having at least three legs. The structure is built so that it may be moved by the transporter lifting from the center of the elevated bottom of the structure. The crusher is fed by an apron feeder which is supported by a frame structure. Like the crusher structure, this feeder support frame is constructed so that it can be lifted from underneath alternatively with the use of an adapter. A self propelled, short belt conveyor may be disposed with one of its ends underneath the crusher to carry crushed rock and ore to a final belt conveyor which runs up and out of the mine. This final belt conveyor is powered by a portable drive station, which is constructed so that it too may be lifted from its underside by the same transporter vehicle.

BRIEF DESCRIPTION OF THE DRAWINGS

FIG. 2 is a sectional view of the raw material feeding end of the apron feeder;

FIG. 3 is a side view of the mid portion of the apron feeder showing the support frame therefor;

FIG. 4 is a side view of the discharge end of the apron feeder positioned over the crusher assembly, only a portion of which is shown;

FIGS. 8*a–c* are side elevational views of the means used respectively for securing the transporter to the crusher assembly, the portable drive station and the apron feeder;

DETAILED DESCRIPTION OF THE INVENTION

Figure 1:
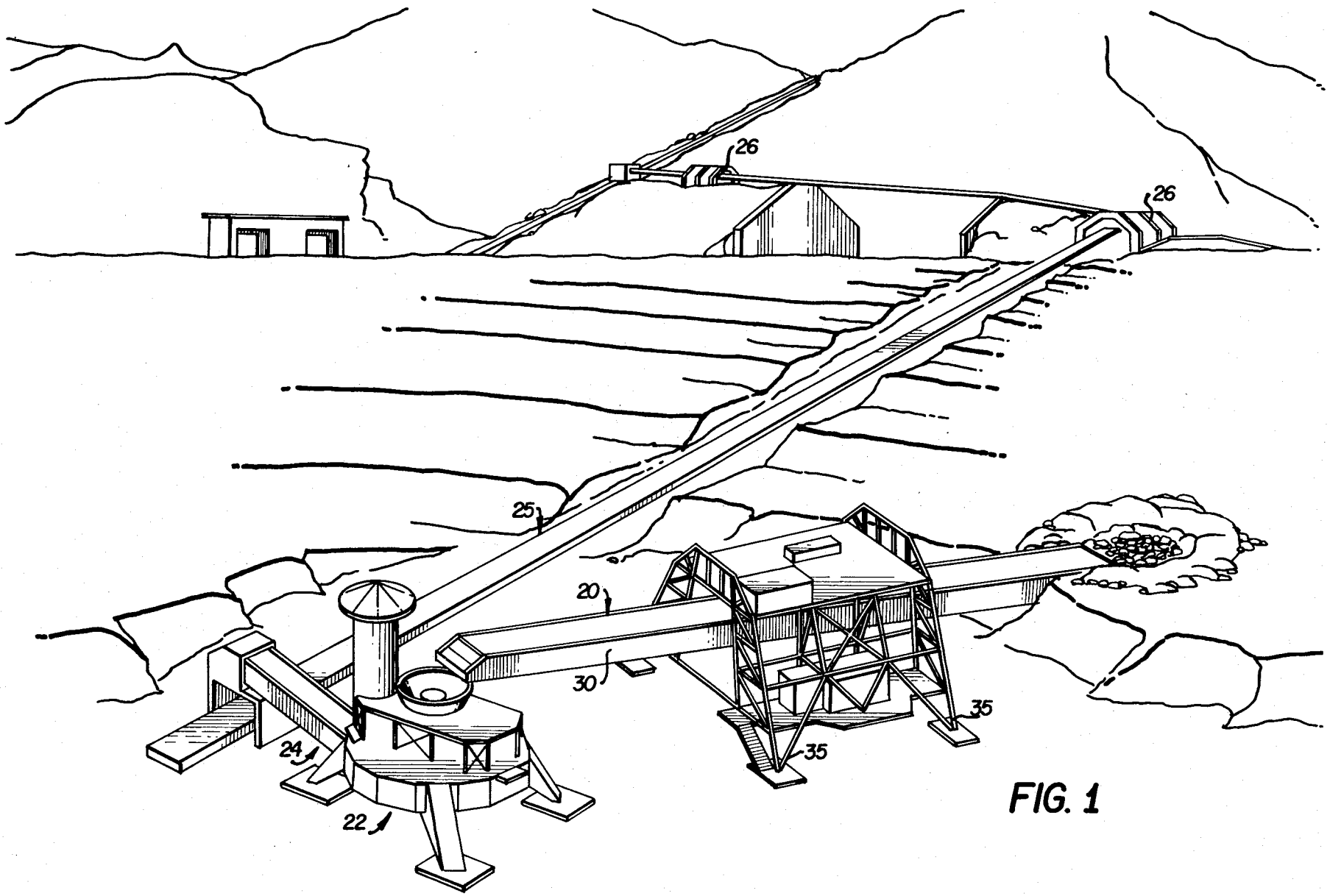
FIG. 1 is an overhead perspective view of the present crushing and conveying system in operation in an open pit mine.
Figure 5:
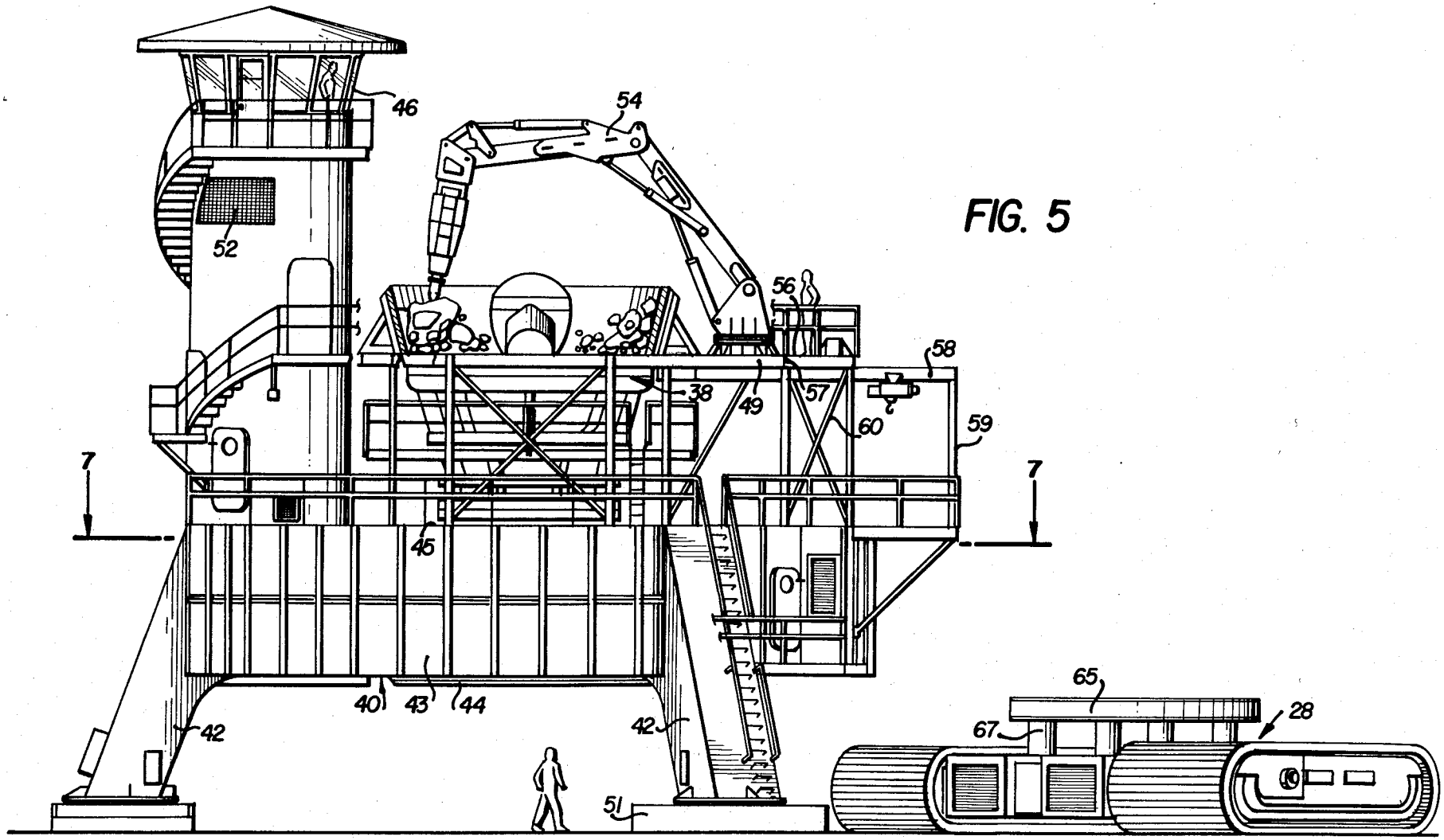
FIG. 5 is a side elevation of the crusher assembly in operation.

Referring first to FIG. 1, the crushing and conveying system of the present invention has four major components. The apron feeder 20 feeds newly mined usually large pieces of raw material to the crushing assembly 22. After passing through the crusher 22 the crushed ore drops onto the belt conveyor 24, which conveys the crushed material to a final belt conveyor 25, which is driven by a portable drive station 26. The apron feeder assembly 20, the crusher 22 and belt drive stations 26 are all designed to be lifted and moved to a new location by a track driven transporter vehicle 28 (see FIG. 5), as will be more fully explained later.

Figure 2:
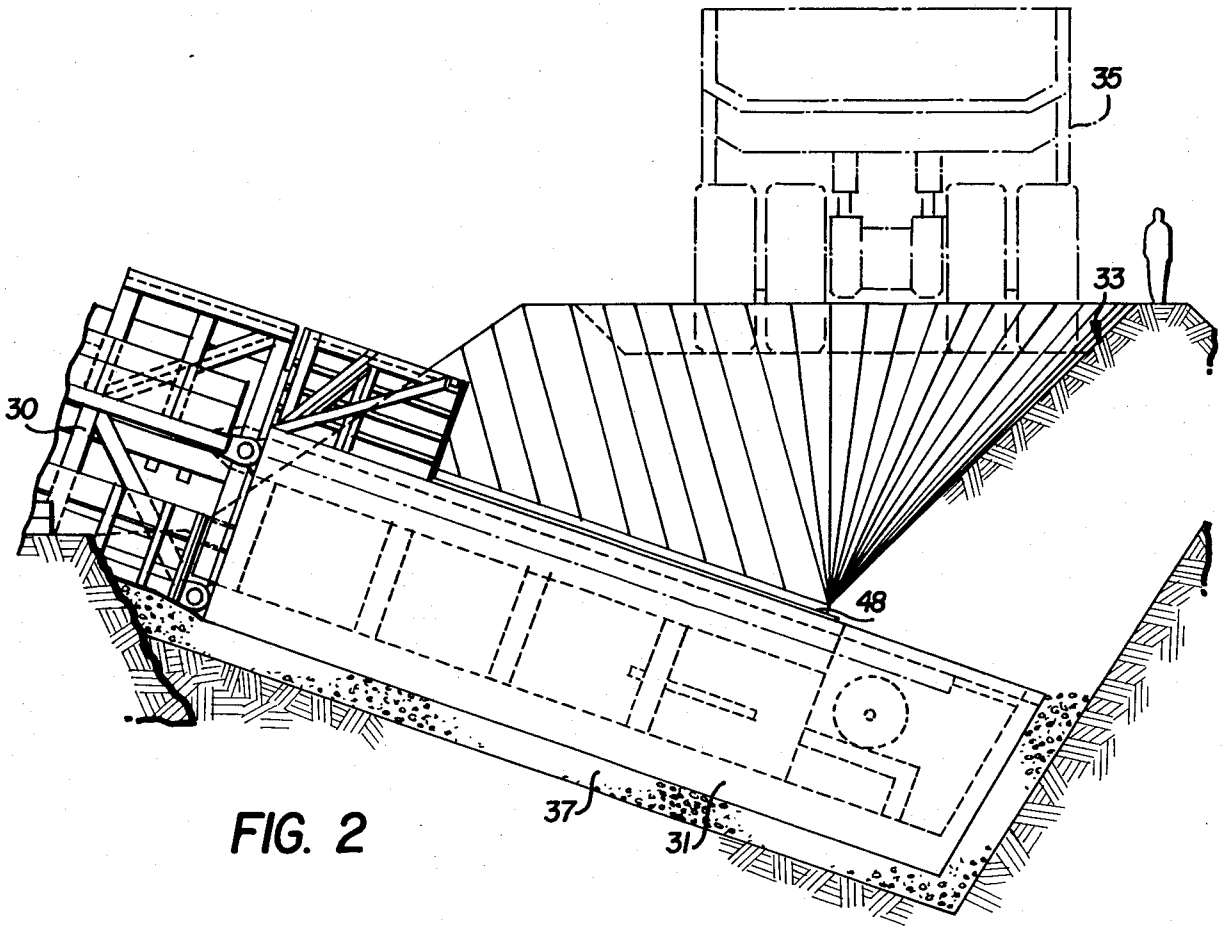
FIGS. 2–4 may be placed together to illustrate the crusher apron feeder.
Figure 3:
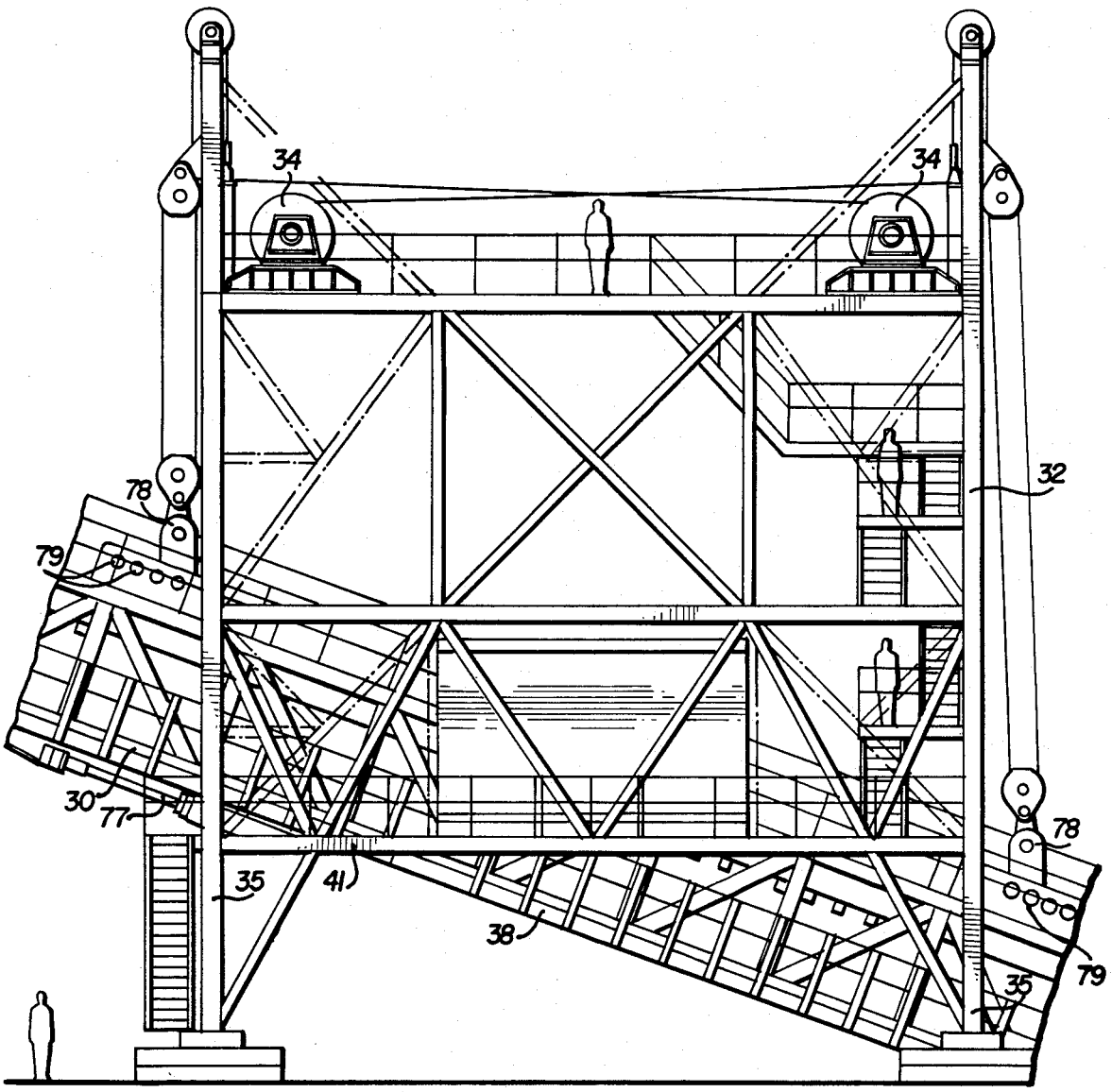
Figure 4:
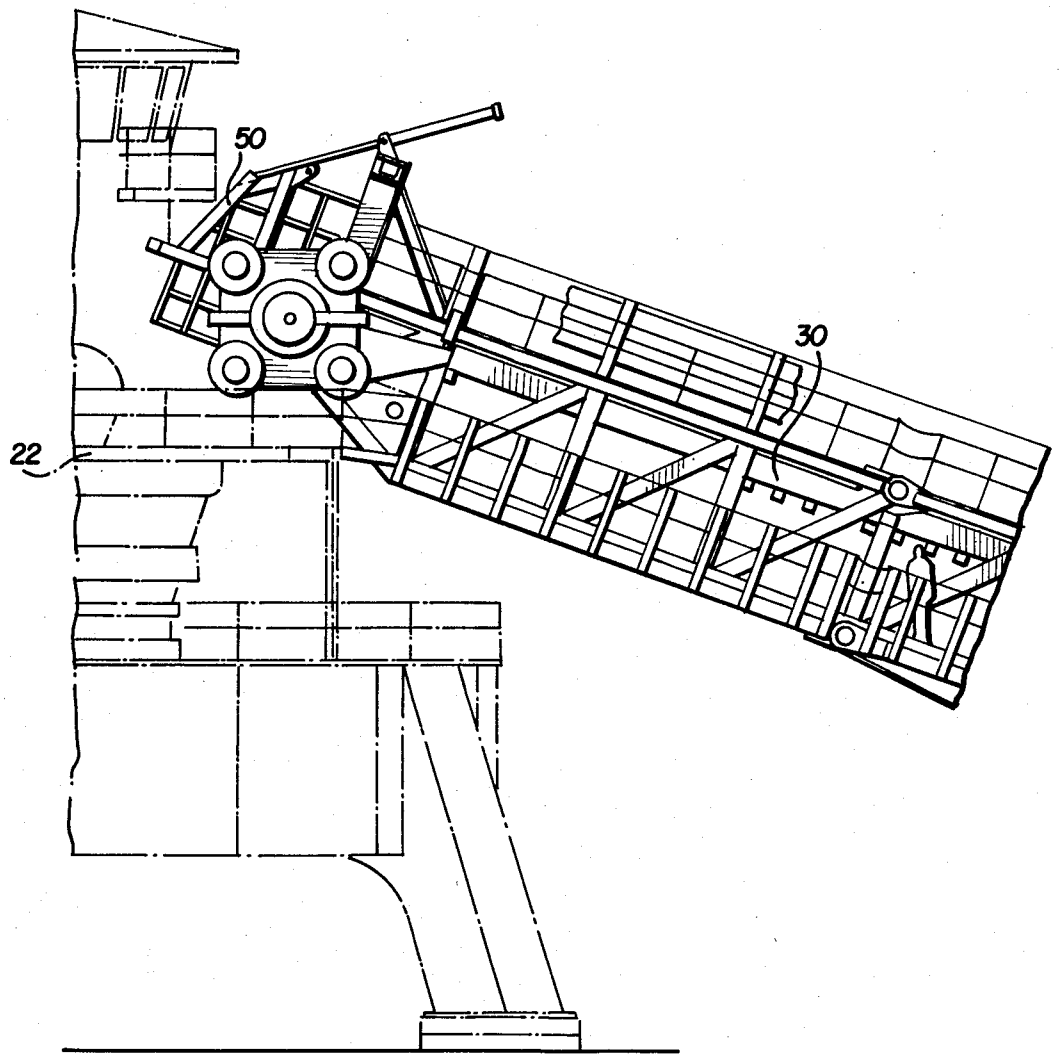

The apron feeder 20 can best be seen overall in FIG. 1. It can be viewed in detail by placing together FIGS. 2, 3 and 4 which show respectively the lower (inlet), middle and upper (discharge) portions. Referring to FIGS. 2–4, the apron feeder has a support structure 30 which is supported by a frame 32 preferably by being suspended by means of the hoist mechanisms 34. The use of two double hoist mechanisms, one at each end of frame 32, allows the slope of the apron feeder to be varied to suit site conditions. As seen in FIG. 2, the inlet end of the apron feeder is provided with a feed house 31. As can be seen in FIG. 4, the discharge end of the apron feeder has a discharge chute 50 for directing material into the crusher 22.

The feed house 31 of the apron feeder is preferably set in an excavation 33, which may be dug into either the grade level of the mine floor or into the side of a previously mined bench. The hoist mechanisms 34 allow either situation to be accommodated. The excavation is dug larger than needed and no metal plates, as usually used, are placed on the sides of the excavation. The feed house has an angle iron 48 to provide a retaining lip against which a slope may be embanked. During initial operation, when a dump truck 39 dumps the first few loads into a new feed house in an oversize excavation, the relatively fine material from that load fills the extra space and is retained on the dirt walls to provide a hard surface over which subsequent loads will be dumped. That fine material thus replaces the steel wear plates previously used to cover the sides of an excavation, and which were subject to extreme wear. The angle iron 48 is replaceable, and a visual wear indicator may be provided behind the angle iron, which becomes visible as the angle iron becomes worn, thus indicating when the angle iron must be replaced. The feed house 31 is preferably an integral metal structure which surrounds the input end of the apron feeder 20 and protects it from damage. A layer of sand 37 is placed into the excavation under the feed house to assist in positioning it.

During operation, the apron feeder support frame 32 is supported by its legs 35. The frame structure is constructed so that a horizontal member 41 of the frame, located inside the perimeter defined by the legs, extends below the lower platform 36 of the apron feeder. This member 41 of the frame structure is secured to a vertical member of the support frame 32, is capable of carrying the entire weight of the apron feeder and the frame, and is adapted to be lifted by transporter vehicle 28. As will be explained later, the transporter vehicle is the same transporter 28 which is used for the crusher 22. When used for the feeder it is preferably provided with an adapter 74 to lift the apron feeder. This adapter 74 will be discussed in detail in connection with FIGS. 8*c* and 9.

Figure 6:
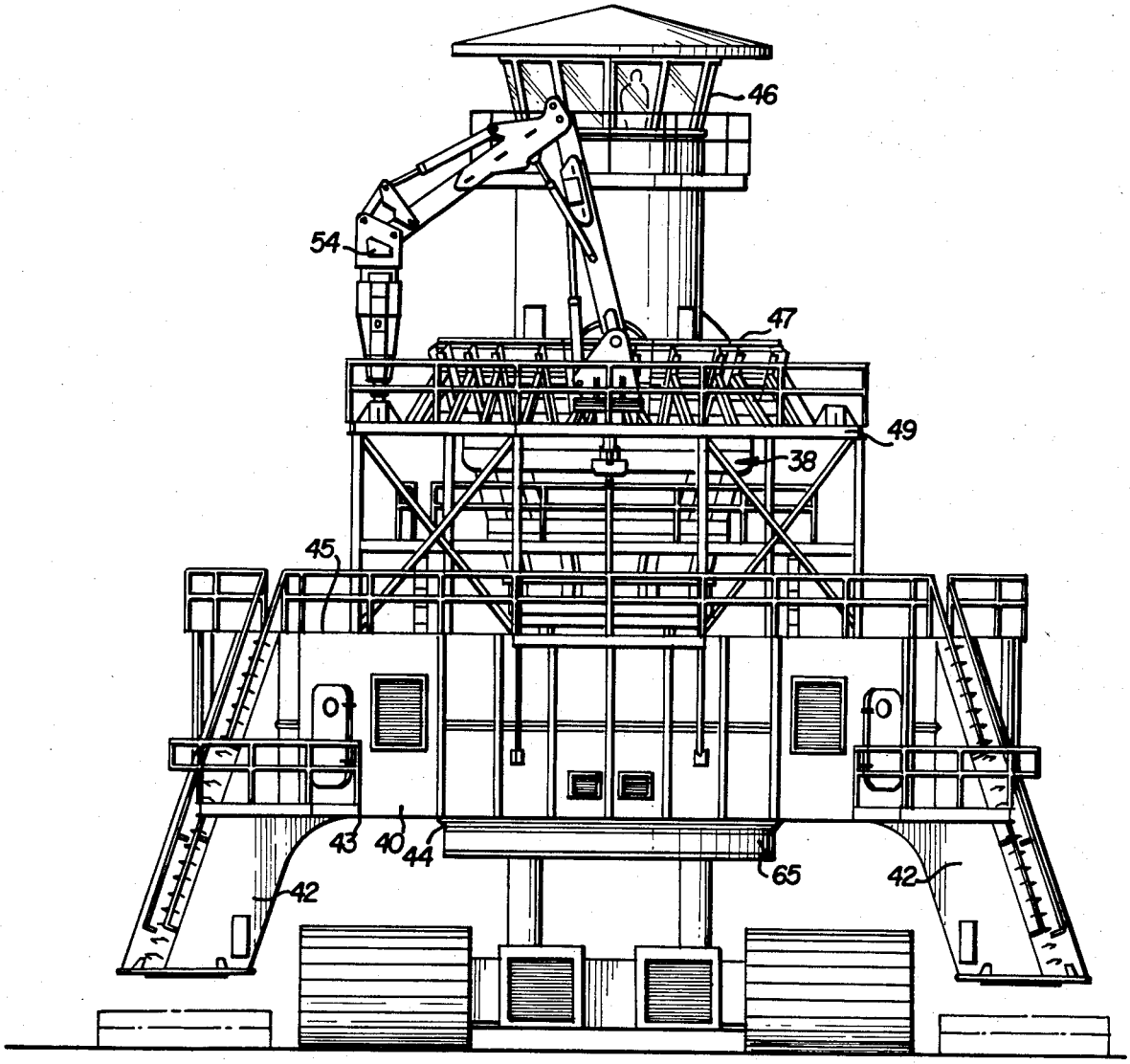
FIG. 6 is a side elevation of the crusher assembly supported on the transporter vehicle.

Referring to FIGS. 5–7 and 10, the crusher assembly 22 includes a gyratory crusher 38 supported on a structure 40. The crusher 38 is supported in an elevated position by a toroidal body on hollow legs 42. The underside of the structure 40 supporting the crusher is provided with a ring 44, which is capable of supporting the entire weight of the crusher assembly. It is this ring 44 which cooperates with the transporter vehicle as shown in FIGS. 6 and 8*a*. This ring is of a size directly to receive the lifting ring 55 of the transporter and there is no need to provide the transporter with an adapter, as could be the case with the apron feeder.

Figure 7:
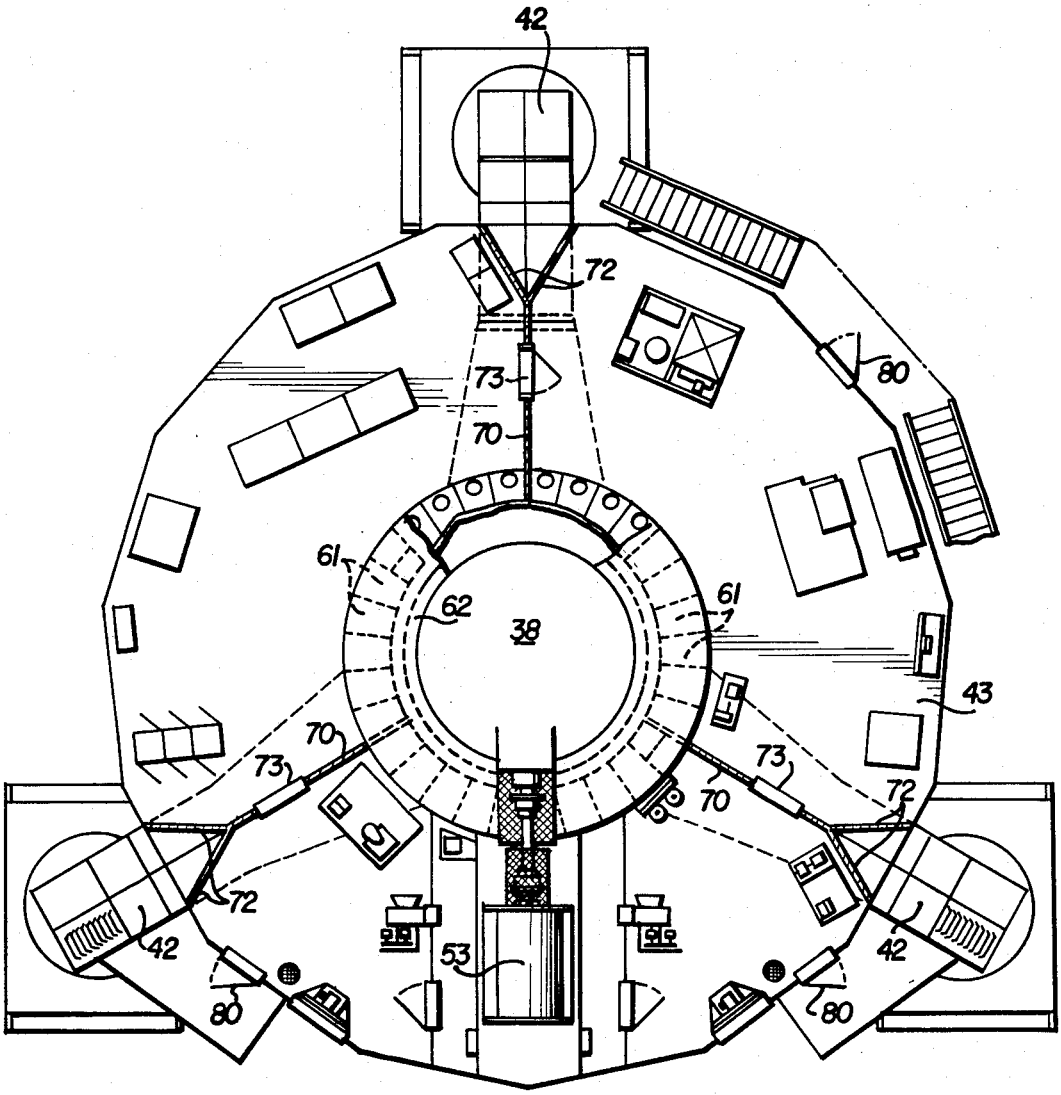
FIG. 7 is a sectional view of the crusher assembly taken along line 7—7 of FIG. 5.

The crusher assembly toroidal body is of sufficient size to have a plurality of rooms within the body to house the motor for driving the crusher and the various hydraulic and electric systems associated with the crusher assembly (FIG. 7). A control tower and observation booth 46 are provided, along with a rock hammer 54, which may be used to break up rocks which are too large to pass through the initial entry of the crusher. The gyratory crusher operates in a fashion similar to a mortar and pestle and in a preferred embodiment is an Allis-Chalmers 60-89.

The configuration of the toroidal assembly utilizes a plate shell structure to carry the loads similar to the construction used for building ships. The shell structure was selected based on the ability to use the structural plate elements not only to carry the loads efficiently but also to provide an enclosure for the equipment associated with the crusher.

The basic shell structure used to support the crusher and associated equipment is a modified toroid. The modified torus is a semimonocoque structure characterized by a stiffened plate skin that carries a major part of the loads.

The crusher is supported at the center of a ten foot deep torus by a series of gusset plates 61 which are welded to the inner ring 62 of the toroid which are directly above outer (lifting) ring 44. The toroid is supported on three legs, the bottom deck thereof being approximately twelve feet above the ground. The toroid is fifteen sided on the exterior and approximately 48 feet in diameter. The interior of the toroid is a 21 foot diameter circle. The centers of the legs are on a 58 foot diameter circle.

The upper and lower decks 43 and 45 of the toroid consist of floor plate and beams to carry the equipment loads and floor live loads to the toroid walls. The toroid walls act as deep beams to transfer the loads to three upside down "L" shaped shear walls 70 that run radially inside the toroid and vertically continuously down and through the center of each support leg. These shear walls are of $\frac{3}{4}$ inch steel plate and form an important part of the load transferring means from the toroidal body to the legs, in addition to stiffening the legs. The shear walls are secured at their upper and lower edges to the upper and lower decks 43 and 45 at their inner edges to inner ring 62 as well as to floor beams which they intersect preferably by continuous welds.

Diagonal transition plates 72 at the junction of the legs and body provide a strong connection between the shear wall, the toroid and the leg. The main shear walls, adjacent the transition plates are rounded at the transition into the leg to reduce stress concentrations.

The shear walls pass through the toroidal body along a radius thereof and form a wall-to-wall and floor-to-ceiling partition within the annular space inside the body. Doorways 73 through the shear walls provide access between the truncated pie-shaped rooms. These doorways and exterior doorways 80 are equipped with gasketed air tight steel doors as in a ship. The perimeters of the doorways 73 are reinforced to avoid any loss of structural strength due to the openings.

The legs are box sections five feet square. An interior cruciform stiffens the exterior plates against buckling. The three legs rest on rectangular steel footing pads 51 that are placed and leveled prior to the placing of the structure on them. The maximum soil bearing pressure is about 4000 pounds per square foot. A narrow bearing bar at the center of each leg transmits the leg load to the footing pad, assuring concentric loading of the pad.

A work platform 49 at the top of the crusher thirty-five feet about the ground is of standard construction. Floor plates 56, floor beams 57, monorails 58, columns 59 and bracing 60 support a rock hammer 54, rock backstops 47 and floor live loads. The columns are supported by the upper deck of the toroid. Monorails serve to access equipment hatches in the upper deck.

A control tower, reaching approximately sixty feet above the ground, is supported over one of the three legs and houses ventilation and pressurization equipment. The control room at the top provides for viewing of the crusher rock hammer, and of the apron feeder which delivers the material to the crusher. An operator will control the crusher and feeder from the control room, so the structural vibration due to the operation of the crusher must be small enough at the control room to be tolerable to the operator. The control tower is tied into the toroid by an inverted "T" arrangement below the tower spanning between the upper deck and the lower deck of the toroid.

Plate thicknesses include $\frac{3}{4}$ inch for the inner ring 62 and legs 42, $\frac{1}{2}$ inch for the crusher support gussets 61, $\frac{3}{8}$ inch for the upper deck 43 and $\frac{3}{8}$ inch for the lower deck 45. Computer studies indicate that most stress levels are less than one-half of the allowable stresses. The resulting vertical deflection at the center of the crusher is about $\frac{3}{8}$ inch.

The proposed structure is very stiff and member stresses are generally low. Vibrational characteristics are a most important aspect of the design. Member stresses due to the dynamic load are small and should not present major fatigue problems because continuous welding is used and the welds are of good quality.

The weight of the structure is approximately 700 tons, which is well within the limit of 1250 tons imposed by the capacity of the transporter vehicle 28. Because of the favorable weight of the structure, no attempt has been made to reduce any of the plate thicknesses in order to reduce weight. Such a reduction would increase the structure's flexibility and thereby increase the vibrational amplitudes.

The crusher assembly 22 is disposed underneath the delivery end of the apron feeder. The apron feeder has a feed chute 50 (shown in FIG. 4 in its retracted position) provided with hydraulic jacks for pivoting the feed chute to the retracted position when it is necessary to gain access to the rock crusher, for example to replace a heavy part. The generally toroidal frame of the crusher assembly is provided to keep the weight of the assembly low, provide a low center of gravity and to make it easier to pressurize the interior frame, which aids in keeping the machinery inside free of dust and hence more free of mechanical failure. The gyrator crusher itself sits within the center of the toroid. Air for pressurizing the interior is supplied through ventilation opening 52, located on the back side of the tower. This is done to decrease the likelihood of drawing in dust from the crushing operation. The tower is diametrically opposite rock crusher motor 53. The blower for the ventilation system is disposed within the control tower and between the ventilation opening 52 and the upper deck of the toroid. Preferably, the blower is mounted on an outwardly opening exterior door in the control tower, which may be opened for servicing the blower.

Stationed beneath the crusher assembly is discharge conveyor 26. This device is small enough so that is can be conveniently made self propelled. The height of the delivery end of this conveyor is preferably variable through the use of hydraulic jacks. This conveyor can be moved through four individually-powered wheels, which are capable of being turned through 360° to provide increased mobility. To decrease the wear on these wheels, hydraulic lifters may be provided to bear the weight of the conveyor after it has been positioned underneath the crusher assembly.

This discharge conveyor delivers crushed ore to a final endless conveyor which is driven by portable drive station 26. As was the case with the apron feeder and the crusher assembly, this drive station is substantially self contained, and may be lifted and moved by use of the same transporter vehicle 28. The underside of the frame of the drive station is provided with a ring, as shown in FIG. 8*b*, which like the ring 44 on the crusher assembly, can support the entire weight of the drive station.

Each leg of the apron feeder support frame, crusher assembly and drive station rests upon a heavy steel pad. The height encompassed by each pad may be varied by providing the pad with a hydraulic lifting system capable of lifting the pad a short distance. Of course, the pads must be carefully positioned prior to moving the feed station, crusher assembly or drive station into position.

The transporter 28 is driven by caterpillar tracks. It is provided with a lifting ring 65, below which are disposed a plurality (preferably 4) of heavy hydraulic jacks 67. The heavy hydraulic jacks may be provided with a leveling sensor so that lifting ring 65 remains level even during travel on a grade. Referring to FIGS. 8*a–c*, the lifting ring has a plurality of hydraulic latching units 66 which grasp the structural rings of the drive station or the rock crushing assembly. To lift the apron feeder it is necessary to have means on the support to connect with the transporter. Thus the lifting ring may be attached to an adapter 74 which has four radially extending members 75 which have hydraulic latching units 66 which cooperate with the structure of the apron feeder, as shown in FIGS. 8*c* and 9.

Figure 9:
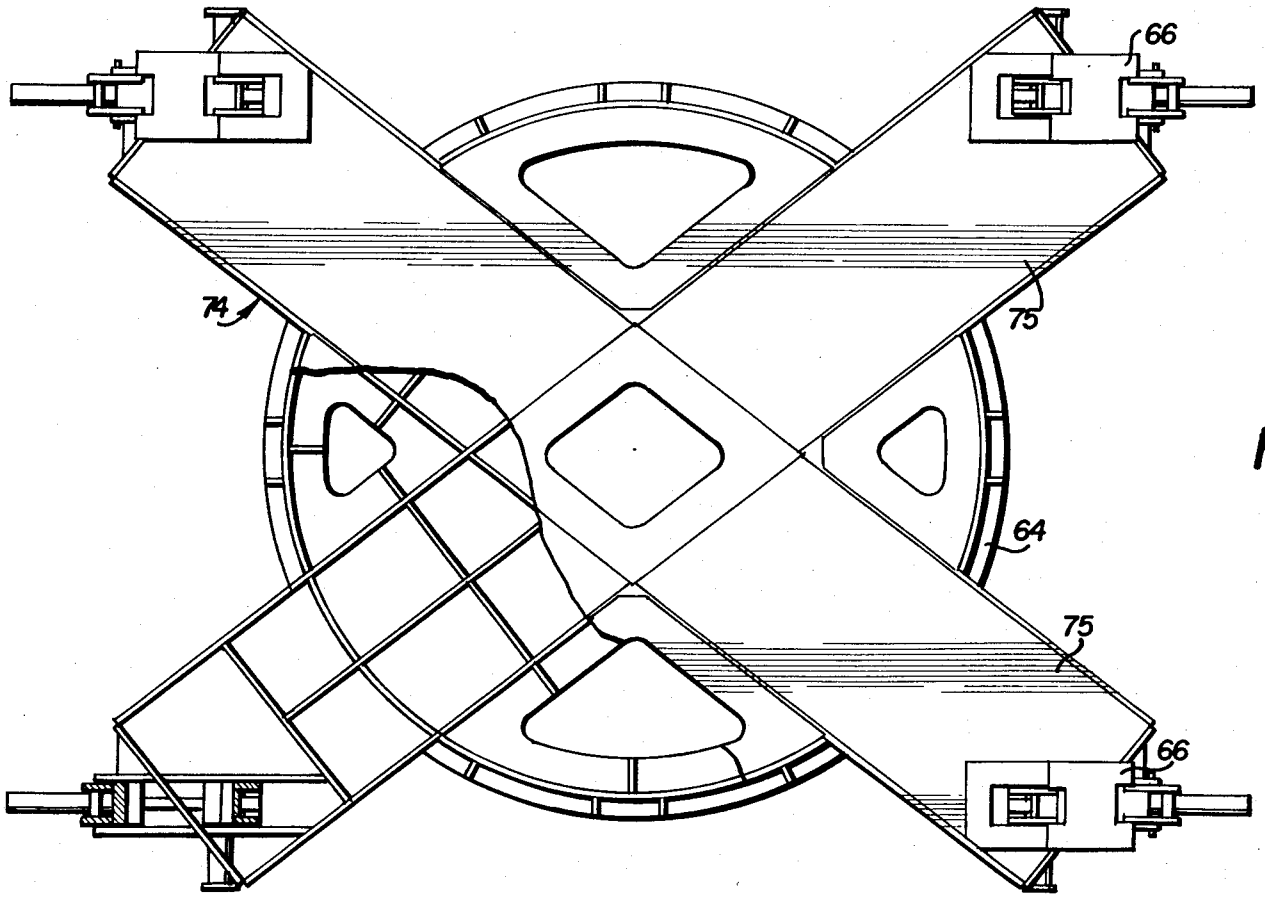
FIG. 9 is a plan view partially in section of an adapter useable for lifting the apron feeder support frame.

FIGS. 8*c* and 9 illustrate the adapter used for connecting the transporter vehicle 28 to the apron feeder support frame horizontal member 41. Because of the great length of the apron feeder 20 in relation to the width of the transporter which is used to move it, it is important that the feeder be carefully balanced when being carried on the transporter. At times, due to the grade of slopes over which the feeder-transporter unit may be moved, it may be necessary to adjust that balance during the moving operation. Means are provided longitudinally to shift the apron feeder support 30 in relation to the frame 32. Hydraulic ram 77 has one end pivotally and vertically moveably attached to the support frame 32 and the other end pivotally attached to the feeder support 30. Thus expansion or retraction of this ram will move feeder support frame 30 (to the left or right in FIG. 3) in relation to frame 32. Thus the balance point can be changed or the entire apron feeder mechanism can be shifted in relation to the support frame 32 so as better to position the feeder in relation to feed house 31 (see FIG. 2) or the feed house in relation to the excavation which has been dug to house it.

When it is desired to move the crusher-feeder installation, the crusher 22 is first moved away from the site so as to make more room for access of the feeder 20. Hoist mechanisms 34 of apron feeder 20 are then actuated so as to lift feeder support frame 30 out of the excavation. The hoisting mechanisms are then lowered so that support 30 touches the ground, thus taking the strain off the hoisting mechanisms and particularly the lower blocks 78 thereof which are secured to support 30 by removable pins. A plurality of holes 79 are available for placement of those pins so that the lower blocks 78 can be placed in a different position better to balance the support 30 in relation to the frame 32. After the desired hole 79 has been selected for placement of the removeable pin, the hoisting mechanisms are again actuated and the support 30 is raised to a level so that its lower platform 36 is slightly above horizontal member 41 of the frame 32. Adaptor 74 (see FIGS. 8*c* and 9) is then placed under horizontal member 41 and hydraulic latching units 66 are actuated so as to grip member 41 as shown in FIG. 8*c*. When adaptor 74 is properly in place it has a ring 64 on its bottom which is positioned for engagement with lifting ring 65 of the transporter. The transporter is then driven into place under adaptor 74 and hydraulic jacks 67 are actuated so as to bring the lifting ring 65 of the transporter into engagement with the ring on the underside of the adaptor. Hydraulic latching units 66 of ring 65 are then closed so as to fasten the two rings 65 and 67 together. The frame 32 and apron feeder 20 are then ready to be moved as a unit. If necessary during that movement the hydraulic ram 77 can be actuated so as to change the center of balance of the feeder 20 in relation to the transporter 28.

Although FIG. 3 separated shows only one hydralic ram 77, there is another parallel ram directly behind it and the two rams are connected in parallel so as to be expanded and retracted at the same time. A pair of shafts (not shown) secured to support 30 run parallel to the rams 77 and through openings in support frame 32. These shafts have holes diametrically therethrough into which pins can be placed so as to lock the support 30 in relation to the frame 32. Thus, after the pins are in place, the hydraulic rams can be depressurized and the strain carried by the shafts and pins either during moving or during normal operation.

Figure 10:
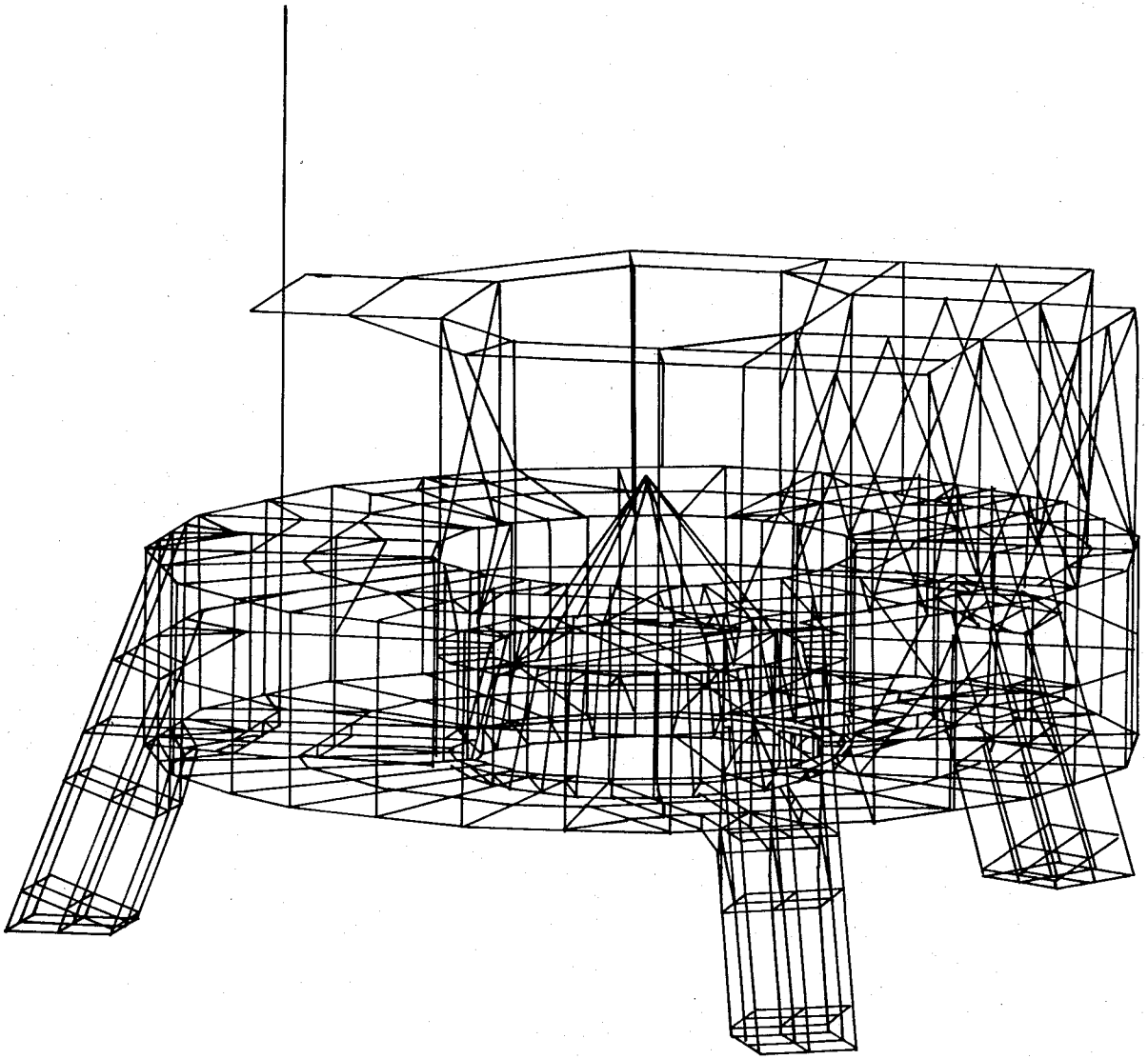
FIG. 10 shows a schematic line drawing of the toroid body frame skeleton used to support the gyratory crusher.

FIG. 10 shows a computer model of the crusher support structure resting on the ground in an undeformed shape. The model was made up of 625 nodes and approximately 1800 elements. For convenience in illustration shear walls 70 and diagonal transition plates 72 have not been shown therein. The basic structure of the body and its legs is clear from this figure, showing a generally toroidal body supported above the ground on three legs and spaced above the ground to permit the transporter vehicle to move under the body. The body has a central cylindrical cavity to house the gyratory or oscillatory crusher apparatus. That crusher receives raw material from above and discharges crushed material from the bottom as described herein. The toroidal body is a semimonocoque structure with a steel skeleton having a plurality of steel beams which defines an annular upper deck, an annular lower deck and a generally circular circumferential outer wall which connects the upper and lower decks. The three legs are equally spaced about the circumferential outer wall so that a vertical plane through the center of a leg would lie along a radius of the toroidal body. As viewed in elevation, the legs are flared radially outwardly so that the lower ends of the legs rest on the ground on a circle of greater diameter than that of the circumferential outer wall. The steel skeleton is covered by an outer skin of steel plates which are secured to the steel beams, for example by continuous welding so that the plates carry a major part of the load and the toroid walls act as deep beams to transfer load to the legs. This load transfer is of course assisted by the shear walls 70 which extend from the center of the toroid radially outwardly and downwardly through the central portion of each leg.

The body has a support ring on the underside of the lower deck for engagement with the transporter vehicle as previously mentioned. This support ring is in turn welded or otherwise securely fastened to the inner ring of the toroid which is in turn secured to the radially inner edges of the shear walls. Thus a strong integral frame work is formed so there is a minimum of deflection when the toroid is carried on the transporter by its lower ring 44 or when resting on the three legs.

What is claimed is:

1. A portable crusher for use in an open pit mine and moveable from site to site by a separate transporter vehicle comprising:

a generally toroidal body supported above the ground by at least three legs and spaced above the ground to permit said transporter vehicle to move underneath the body, said body having a central cylindrical cavity housing a gyratory crusher apparatus positioned to receive raw material from above said cavity and discharge crushed material from the bottom of said cavity;

said toroidal body comprising a semimonocoque structure having a steel skeleton of a plurality of steel beams defining an annular upper deck, an annular lower deck, a generally circular circumferential outer wall connecting said upper and lower decks and at least three legs equally spaced about said circumferential outer wall and extending downwardly from said lower deck and flared radially outwardly so that the lower ends of said legs rest on the ground on a circle of greater diameter than that of said circumferential outer wall; said steel skeleton being covered by an outer skin of steel plates secured to said steel beams so that said plates carry a major part of the load and the toroid walls act as deep beams to transfer load to the legs;

said body having a support ring on the underside of said lower deck for engagement by such a transporter vehicle when being moved;

said body further having hollow spaces between said upper and lower decks and said outer wall and central cavity for housing equipment associated with said crusher.

2. The crusher of claim 1 including a shear wall within at least three of said legs, said shear wall extending radially outwardly from the central cavity and secured to the cavity wall, the upper and lower decks and the outer circumferential wall so as to stiffen the structure.

3. The crusher of claim 2 including at least one transition plate secured to each shear wall near its junction with its associated leg, said transition plate being at an acute angle to the shear wall and extending diagonally outwardly and downwardly with its outer edge secured to an inner surface of one of said associated leg and the adjacent portion of the circumferential wall.

4. The crusher of claim 1 including a pivotal arm mounted on said upper deck and carrying a tool for breaking large pieces of raw material and guiding that material into said crusher.

5. The crusher of claim 1 including a control tower extending upwardly from said upper deck and housing a control room overlooking the top of said crusher.

6. The crusher of claim 5 in which the lower part of said control tower houses equipment associated with said crusher.

7. The crusher of claim 5, wherein the interior of said control tower is in fluid communication with the interior of said toroid to pressurize it, and said control tower has an air intake means and blower means.

8. The crusher of claim 7, wherein said air intake means is disposed on a surface of the tower facing away from the crusher apparatus, said blower means being located between said air intake and the upper deck of said toroid, and being mounted on an outwardly opening door.

9. A portable crusher and apron feeder assembly for use in a mine and moveable from site to site by a separate transporter vehicle having a vertically moveable carrier, said assembly comprising:

a top fed crusher centrally housed in a generally toroidal body, said body having at least three legs supporting it above the ground to permit such a transporter vehicle to move underneath the body;

said toroidal body comprising a skeleton of steel beams defining an annular upper deck, an annular lower deck and a generally circular outer wall connecting said upper and lower decks, said skeleton having an outer skin of steel plates secured thereto to form a semimonocoque structure;

a support ring on the underside of said lower deck for engagement by said transporter vehicle carrier when being moved;

an apron feeder assembly adjacent the crusher for feeding raw material into the top of the crusher, said conveyor having an endless belt on a belt support means;

a frame structure for supporting said apron feeder support means and having at least four legs, and a lower member below the apron feeder support;

a support means on the underside of said lower member for engagement with the carrier of the transporter vehicle so that the transporter vehicle can lift and move the apron feeder assembly separately from the crusher.

* * * * *